US006993856B2

(12) United States Patent
Benali et al.

(10) Patent No.: US 6,993,856 B2
(45) Date of Patent: Feb. 7, 2006

(54) APPARATUS FOR PRODUCING POWDER FROM BIOMATERIALS

(75) Inventors: Marzouk Benali, Longueuil (CA); Mouloud Amazouz, Longueuil (CA)

(73) Assignee: Her Majesty the Queen in right of Canada, as represented by the Minister of Natural Resources, Ottawa (CA)

( * ) Notice: Subject to any disclaimer, the term of this patent is extended or adjusted under 35 U.S.C. 154(b) by 157 days.

(21) Appl. No.: 10/714,598

(22) Filed: Nov. 18, 2003

(65) Prior Publication Data

US 2005/0050761 A1 Mar. 10, 2005

(30) Foreign Application Priority Data

Sep. 4, 2003 (CA) ..... 439490

(51) Int. Cl.
*F26B 17/00* (2006.01)

(52) U.S. Cl. ..... 34/583; 34/174; 34/576

(58) Field of Classification Search ..... 34/583, 34/576, 587, 168, 174, 226, 218
See application file for complete search history.

(56) References Cited

U.S. PATENT DOCUMENTS 3,634,949 A * 1/1972 Louks ..... 34/174
3,913,239 A * 10/1975 Burgin ..... 34/102
4,159,580 A * 7/1979 Welch, Jr. ..... 34/168
4,337,584 A * 7/1982 Johnson ..... 34/65
5,386,974 A * 2/1995 Hardie et al. ..... 266/157
5,653,043 A * 8/1997 Bestwick et al. ..... 34/171
5,809,664 A * 9/1998 Legros et al. ..... 34/347

OTHER PUBLICATIONS

Benali, M., (2003). Thermal drying of foods: loss of nutritive content and spoilage issues. In A.S. Mujumdar (Ed.), Drying of products of biological orgin. Enfield: Oxford IBH and Science Publishers (In Press).

Barrett, N. & Fane, A. (1989). Drying liquid materials in a spouted bed. In A.S. Mujumdar & M. Roques (Ed.), Drying '89 (pp. 415–420), New York: Hemisphere Publishing Corporation.

Oliveira, W.P. & Freire, J.T. (1996). Analysis of evaporation rate in the spouted bed zones during drying of liquid materials using a three region model, Proceedings of the 10th International Drying Symposium (IDS'96), Kraków–Poland (vol. A.pp. 504–212).

Spitzner–Neto, P.I., Cunha, F.O. & Freire, J.T. (1982). Effect of the presence of paste in a conical spouted bed dryer with continous feeding, Drying Technology, 20,789–811. [Published by Marcel Dekker Inc. New York].

(Continued)

*Primary Examiner*—Ira S. Lazarus
*Assistant Examiner*—Kathryn S. O'Malley
(74) *Attorney, Agent, or Firm*—Shapiro Cohen

(57) ABSTRACT

A jet spouted fluidized bed drier is described in which the bottom half of the drier chamber comprises a first lower conical part, and the top half of the drier chamber comprises a second upper conical part surrounding a conical grid located near to the top end of the second part. The drier chamber thus comprises two conical parts connected together at their wide ends. The result of this arrangement is that the collision zone becomes a toroid with an essentially triangular cross-sectional shape defined essentially by the conical internal surface of the top part and the conical outer surface of the conical grid. This revised structural arrangement has been found to be able to process materials which either cannot be processed, or cannot be processed efficiently, with known jet spouted fluidized bed driers. Additionally, this revised structural arrangement has been found to be able to process materials more efficiently, and to a lower desired final liquid content values.

12 Claims, 4 Drawing Sheets

OTHER PUBLICATIONS

Benali, M. & Amazouz, M. (2002). Effect of drying aid agents on processing of sticky materials, Dev. Chem. Mineral Process, 10(3/4), 1–14. [Development in Chemical Engineering and Mineral Processing, The Australian Research Journal, Published by Curtin University of Technology, Australia].

Pham, Q.T. (1983). Behavior of a conical spouted–bed dryer for animal blood, Can. J. Chem. Eng. 61, 426–434. (Canada).

Markowski, A.S. & Kaminiski, W. (1983). Hydrodynamic characteristic of jet–spouted beds. Can J. Chem. Eng, 61, 377–383. (Canada).

Markowski A.S. (1992). Drying characteristics in a jet–spouted bed dryer. Can J. Chem. Eng, 70, 938–944, Canada.

Kutsakova, V.E., Utkin Y.V. & Kupanov, B.Y. (1990). Method for Drying of Liquid Materials, Russian Patent No. 1560948.[English Translation of Abstract].

Ochoa–Martinez, L.A., Brennan, J.G. & Niranjan, K. (1993). Spouted bed dryer for liquid foods, Food Control, 4,41–45. [Published by Elsevier Science, Rotterdam, The Netherlands].

Benali et al., Drying of Value Added Liquid Wastes, Symposium on Energy Engineering, pp. 917–922, 2000. (*New York*).

Spitzner N et al., Analysis Of The Effect Of Paste On The Behaviour Of A Spouted Bed With Inerts, Drying '97 — Proceedings of the 11 International Drying Symposium (IDS '98) Aug. 19–22, vol. C, pp. 1936–1943. [Published by Ziti Editions, Greece].

Benali et al., Energy Efficient Drying Process For Transforming Food By–Products, [Not Published].

Amazouz et al. Preservation Technologies For Food, Feed And Fibre, in New Opportunties For Drying, Infrared, Microwave And Freezing, Seminar Nov. 22–23, 1999, Winnipeg, Manitoba, Canada.

Kutsakova et al., Dewatering Of Solutions In A Fluidized Bed Of Inert Particles, Theoretical Foundations of Chemical Engineering 17 (3) 256–260, 1983, 1984 Plenum Publishing Corporation. [New York].

Kutsakova et al., Some Trends In The Kinetics Of Drying Solutions In A Fluidized Bed Of Inert Particles, 1985 Plenum Publishing Corporation. [Theoretical Foundations of Chemical Engineering, New York].

Kutsakova et al., Kinetics Of Drying Of Protein Pastes, Suspensions, Emulsions, And Solutions In A Fluidized Bed Of Inert Substances.

* cited by examiner

APPARATUS FOR PRODUCING POWDER FROM BIOMATERIALS

FIELD OF THE INVENTION

The present invention relates to an apparatus for drying a slurry of a biomaterial, such as pea starch, whole eggs, and slaughter house wastes or other related biomaterials, in which the slurry is dried by direct contact with hot air containing hot inert carrier particles in a jet spouted fluidised bed dryer.

BACKGROUND OF THE INVENTION

As originally described, a jet spouted fluidised bed dryer consists essentially of a vertical chamber in which the lower part is conical with its narrow end at the bottom, and in which the upper part is a cylinder having essentially the same diameter as the upper wide end of the lower conical part. The top end of the cylinder is closed by an essentially flat horizontal plate which includes a gas outlet. The chamber also contains a suitable quantity of inert carrier particles. A hot high velocity gas stream is injected into the dryer at the lower end of the conical lower part through a gas inlet port, which serves to fluidize and to spout the carrier particles. At the junction of the gas port and the lower end of the conical part a suitable screen is provided to prevent the carrier particles from entering the gas port. The heated carrier particles are initially propelled by the hot gas substantially vertically from near to the screen toward the flat plate closing the top of the cylindrical part. In order to prevent the carrier particles escaping through the gas outlet, a suitable screen is provided near the top of the chamber. In the region underneath the screen, and underneath the horizontal plate around the screen, the hot carrier particles undergo high velocity collisions with each other, with the chamber walls and with the underside of the screen. The carrier particles then return to the bottom of the chamber in a flow near to the inside of the cylindrical and conical chamber walls. The dryer also includes at least one feed port for the slurry of material which is to be dried. The feed port, or ports, is/are often located near to the narrow end or near to the wide end of the lower conical part of the chamber.

In operation, the slurry entering the drying chamber through the feed port(s) is atomised into fine droplets which form a coating on the hot carrier particles. As the coated carrier particles move vertically upwardly in the hot gas stream essentially in the center of the chamber the coating loses any volatile liquids in the slurry, such as water, to form an essentially dry and fragile coating on the carrier particles. When the coated particles enter the region beneath the screen, in a space which may be termed the collision zone, the ensuing collisions break up and detach the fragile dried coating from the carrier particles to provide an essentially dry powder of solid material derived from the slurry. The dry powder is small enough to be carried by the hot gas flow upwardly through the screen, so that the dried solid material powder leaves the drier in the exhaust gas flow through the hot gas outlet. A suitable gas/solid separation system is used to recover the dried product from the exhaust hot gas flow.

One example of a conical jet spouted fluidised bed drier of this type in which inert particles are used as a packing of heat exchanges particles is described by Legros et al., in CA 2,178,575, and also in U.S. Pat. No. 5,809,664. In this example, the jet spouted fluidised bed drier is used to process animal manure to provide a dried product suitable for use in fertilizers.

It can be seen from the preceding description that there are two features of such a jet spouted fluidised bed drier which have a direct bearing on drier efficiency.

The first is that when the carrier particles arrive in the collision zone the coating on the carrier particles should be adequately dry, and contain more or less only the liquid level required in the dried product. If the liquid level in the dried coating is too high, adequate disengagement of the coating from the carrier particles is not possible.

The second is that recovery of the dried solid product formed as a coating on the carrier particles in the drying process relies completely on what happens to the coated carrier particles in the collision region. If the collisions involving the coated carrier particles do not result in substantially complete disengagement of the dried coating, the drying efficiency of the jet spouted fluidised bed drier is compromised, and the rate of dried coating removal does not match the rate at which the solids in the slurry are entering the drier. This can lead to a build up of solids on the carrier particles which will eventually choke the drier.

In practise it has been found that although by controlling the gas flow rate, gas temperature and slurry feed rate the required level of drying of the coating can be obtained with at least some biomaterials. But it appears that the nature of the events in the collision region in a jet spouted fluidised bed drier substantially as described by Legros et al. do not remove the dried coating efficiently from the inert carrier particles. It has also been found that it is effectively impossible to process some biomaterials in the type of drier described by Legros et al. For example, attempts to process meat rendering slurries result in the inner surfaces of at least the collision region becoming coated with oily and fatty components from the meat rendering slurry. The result of this sticky coating is that the drier becomes choked, and ceases to operate properly.

An improved jet spouted fluidised bed drier has been described by Benali et al., in Proceedings of Symposium on Energy Engineering, Hong Kong, 2000. In this improved drier, the bottom conical part of the drier chamber is retained. The top cylindrical part is replaced by an essentially hemispherical part of the same radius as the top end of the lower conical part. The gas outlet is provided at the top of the hemisphere (essentially coaxial with the lower conical part). The flat screen is replaced by a conical grid extending downwardly into the hemispherical part with the cone axis more or less coaxial with the hot gas outlet. Additionally, the slurry inlet port can be located to provide a downwardly oriented atomised slurry flow from a point below the lower end of the conical screen.

The result of these modifications is that the collision region has a quite different shape, as it is the space between the outside of the conical grid and the inside of the upper part of the hemispherical part. Although it has been found that this modified jet spouted fluidised bed drier is an improvement on the drier described by Legros et al. it still leaves considerable room for improvement. For example, it is still not capable of processing meat rendering slurry efficiently.

SUMMARY OF THE INVENTION

This invention seeks to overcome the difficulties encountered with the driers of the types described by Legros et al. and Benali et al. In the jet spouted drier of this invention, the top half of the drier chamber comprises a second upper conical part surrounding a conical grid. The drier chamber thus comprises two conical parts connected together at their wide ends. The result of this arrangement is that the collision zone becomes a toroid with an essentially triangular cross-sectional shape. This revised structural arrangement has been found to be able to process materials which either cannot be processed, or cannot be processed efficiently, with a jet spouted fluidised bed drier substantially as described by Legros et al. or as described by Benali et al. Additionally, this revised structural arrangement has been found to be able to process materials more efficiently, and to lower desired final water content values.

Thus in a first embodiment this invention seeks to provide a jet spouted fluidised bed drier for the drying of a slurry of biomaterials including in combination:

a hot gas inlet means constructed and arranged to allow the passage of hot high velocity gas into the bottom of the chamber in a substantially upward vertical direction;

a first lower conical member in which the cone axis is substantially vertical having its lower narrow end connected to the hot gas inlet and having an upper wide end and a first internal cone angle;

a first lower screen located in the first conical member adjacent its connection with the hot gas inlet means;

a second upper conical member in which the cone axis is substantially vertical and coaxial with the cone axis of the first conical member having its lower wide end connected to the upper wide end of the first conical member and having an upper narrow end and a second internal cone angle;

a hot gas outlet means connected to the upper narrow end of the second conical member constructed and arranged to allow the passage of hot high velocity gas from the upper narrow end of the second conical chamber in a substantially upward vertical direction;

a second upper conical screen having a cone axis, an upper wide end, a lower closed end and a third internal cone angle;

a suitable quantity of inert carrier particles contained within the first and second conical members; and at least one inlet port for the slurry of biomaterials constructed and arranged to provide an atomised flow of the slurry into the chamber;

wherein:

(a) the first lower screen is constructed and arranged to prevent the inert carrier particles from escaping into the hot gas inlet means;

(b) the second upper conical screen has its cone axis coaxial with the cone axis of the second upper conical member;

(c) the second upper conical screen is connected to the second upper conical member adjacent to and surrounding the hot gas exit means; and (d) the second upper conical screen is constructed and arranged to prevent the inert carrier particles from escaping into the hot gas outlet means.

Thus in a second embodiment this invention seeks to provide a jet spouted fluidised bed drier for the drying of a slurry of biomaterials including in combination:

a hot gas inlet means constructed and arranged to allow the passage of hot high velocity gas into the bottom of the chamber in a substantially upward vertical direction;

a first lower conical member in which the cone axis is substantially vertical having its lower narrow end connected to the hot gas inlet and having an upper wide end and a first internal cone angle;

a first lower screen located in the first conical member adjacent its connection with the hot gas inlet means;

a cylindrical member in which the cylinder axis is substantially coaxial with the cone axis of the first conical member having its lower end connected to the upper end of the first conical member and having an upper end;

a second upper conical member in which the cone axis is substantially vertical and coaxial with the cylinder axis of the cylindrical member having its lower wide end connected to the upper end of the cylindrical member and having an upper narrow end and a second internal cone angle;

a hot gas outlet means connected to the upper narrow end of the second conical member constructed and arranged to allow the passage of hot high velocity gas from the upper narrow end of the second conical chamber in a substantially upward vertical direction;

a second upper conical screen having a cone axis, an upper wide end, a lower closed end and a third internal cone angle;

a suitable quantity of inert carrier particles contained within the first and second conical members; and at least one inlet port for the slurry of biomaterials constructed and arranged to provide an atomised flow of the slurry into the chamber;

wherein:

(a) the first lower screen is constructed and arranged to prevent the inert carrier particles from escaping into the hot gas inlet means;

(b) the second upper conical screen has its cone axis coaxial with the cone axis of the second upper conical member;

(c) the second upper conical screen is connected to the second upper conical member adjacent to and surrounding the hot gas exit means; and (d) the second upper conical screen is constructed and arranged to prevent the inert carrier particles from escaping into the hot gas outlet means.

Preferably, the first and the second internal cone angles are the same.

Preferably, the first and the second cone angles are each from about 30° to about 45°. More preferably the first and the second cone angles are each about 40°.

Preferably, the third cone angle is from about 30° to about 45°. More preferably the third cone angle is about 40°.

Preferably, the inert carrier particles are fabricated from a material chosen from the group consisting of glass, polymer resin, polypropylene, PVC, silica gel, cellulose particles and polytetrafluoroethylene. More preferably the inert carrier particles are fabricated from polytetrafluoroethylene.

Preferably, the inert carrier particles are fabricated as spheres or cubes. More preferably, the inert carrier particles are fabricated as spheres. Most preferably, the inert carrier particles are fabricated as polytetrafluoroethylene spheres.

BRIEF DESCRIPTION OF THE DRAWINGS

The invention will now be described with reference to the attached Figures in which:

FIG. 6 shows the results of comparative drying experiments for pea starch.

DETAILED DESCRIPTION

Figure 1:
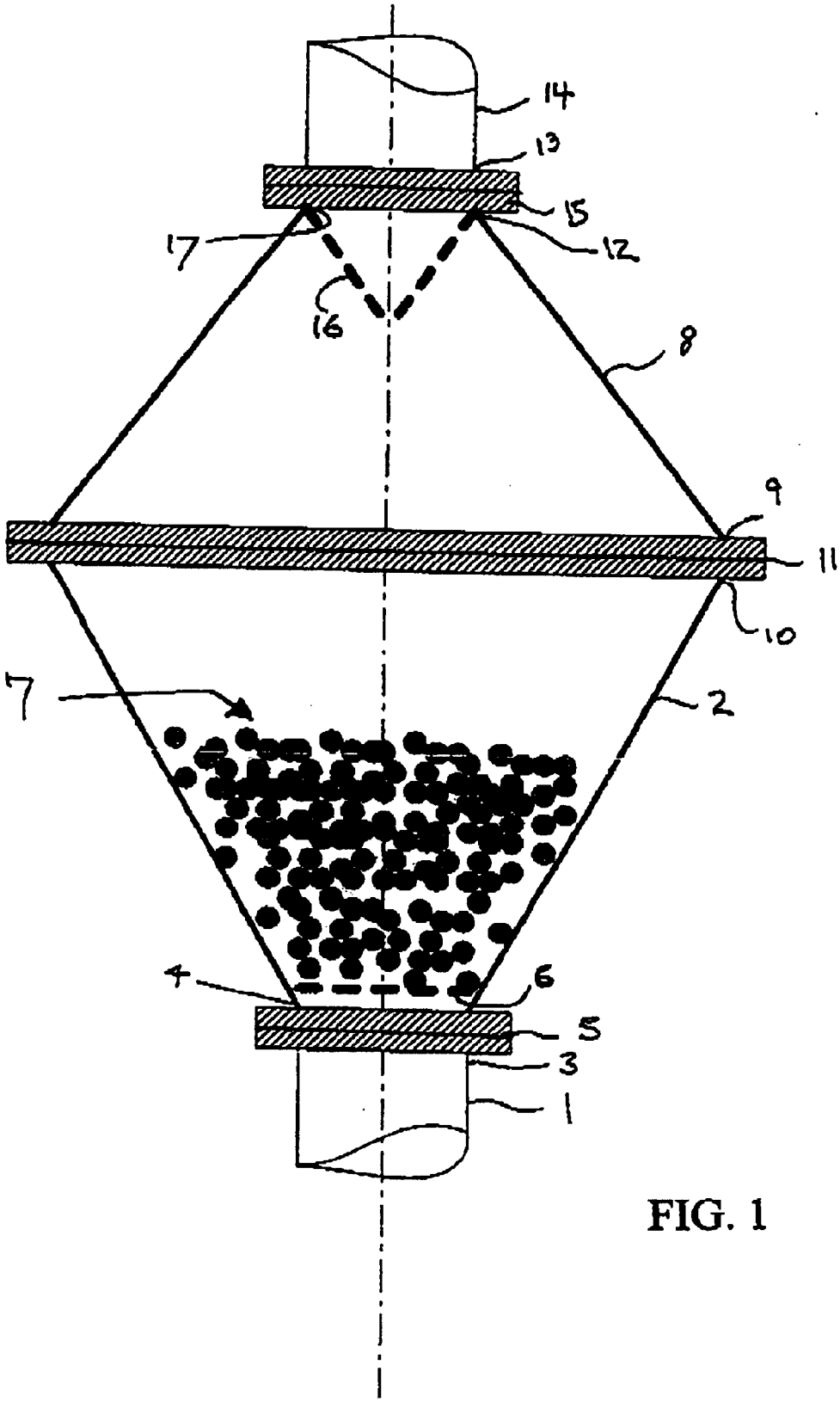
FIG. 1 shows a schematic cross section of a drier chamber according to a first embodiment of the invention.
Figure 2:
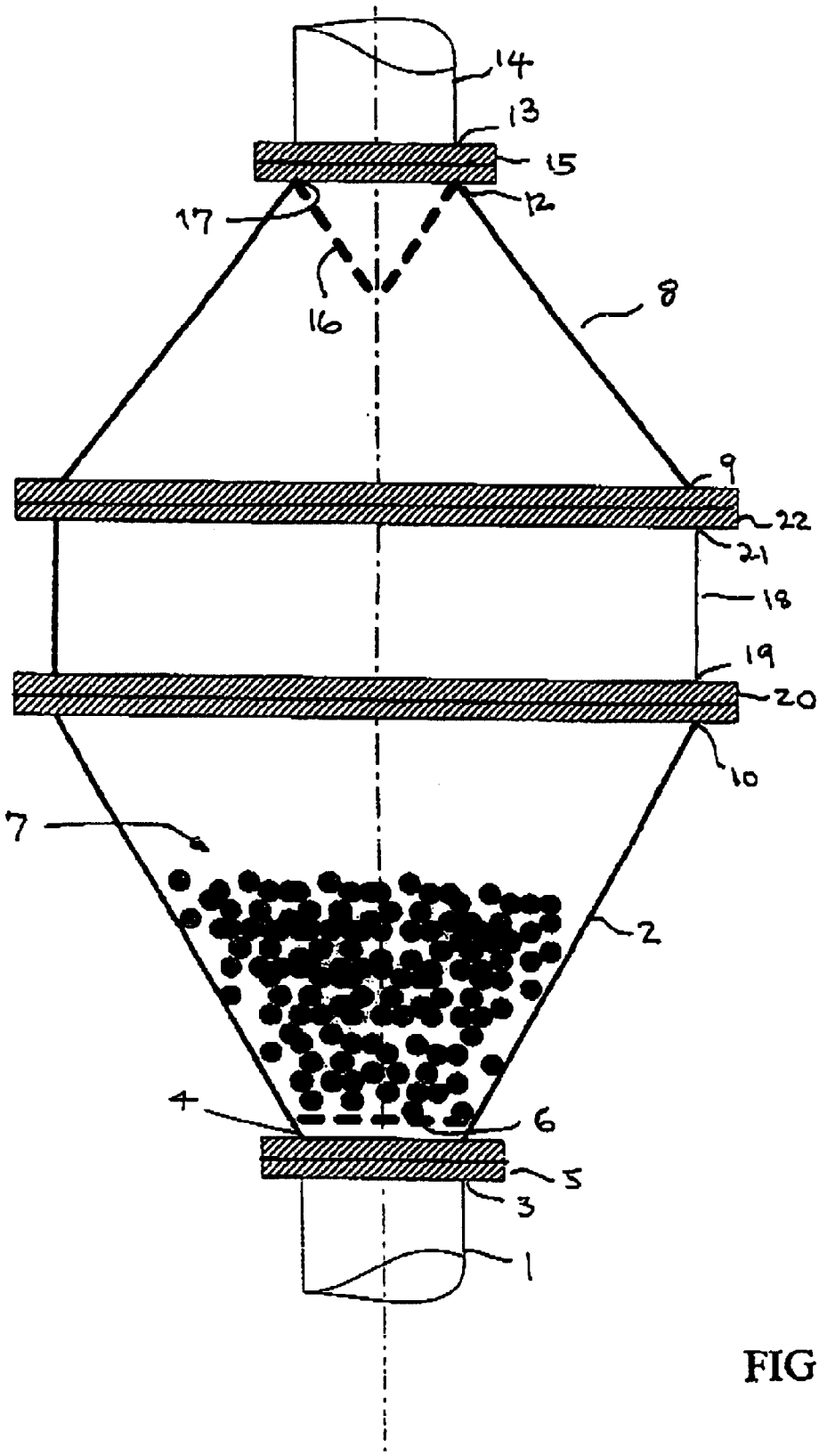
FIG. 2 shows a schematic cross section of a drier chamber according to a second embodiment of the invention.

In FIGS. 1 and 2 only the drier chamber itself is shown for clarity. In practise, to use the drier a number of other units will be needed, for example a suitable high temperature cyclone to separate the dried powder from the hot gas leaving the drier chamber and a source for the hot gas flow. A typical complete unit for the drying of animal manure is shown by Legros et al. in CA 2,178,575.

Referring first to FIG. 1 a schematic cross section of a drier chamber according to a first embodiment of this invention is shown. In FIG. 1 the drier is shown in a static, non-operating, condition.

Starting from the bottom of the drier, the hot gas enters the drier through the hot gas inlet means 1, which in this instance is a suitably sized pipe. Immediately above the hot gas inlet 1 is the first lower conical member 2. The top end 3 of the hot gas inlet 1 is attached coaxially to the narrower end 4 of the first conical member by the first flanged joint 5. In close proximity to the joint 5 the lower screen 6 is located. As shown, the screen 6 serves to keep the charge of inert carrier particles 7 from escaping into the hot gas inlet 1. The open area of the bottom grid conveniently is from about 55% to about 72% of the total area of the grid. The holes in the grid need to be large enough to allow adequate gas flow and small enough to retain the inert particles; experience shows that the hole diameter is about 85% of the equivalent diameter of the inert particles. When the drier is in operation, the inert carrier particles 7 are lifted off the screen 6 by the high velocity hot air flow to follow a path more or less as shown by Benali et. al.

The second upper conical member 8 is attached at its wider end 9 coaxially to the wider end 10 of the first lower conical member 2 by a second flanged joint 11. The narrow upper end 12 of the second conical chamber is attached coaxially to lower end 13 of the hot gas outlet means 14, which in this instance is a suitably sized pipe, by the flanged joint 15.

Although the hot gas inlet 1, the lower and upper conical members 2, 8 and the hot outlet 13 could be attached together in sequence by other means, the use of the flanged joints. 5, 11 and 15 has been found to be convenient as it simplifies dismantling of the drier for cleaning internally.

Inside the top of the second conical chamber a second upper conical screen 16 is located with its wider upper end 17 attached coaxially to the narrow upper end 12 of the second conical member 8 as at 17. The construction of the conical screen 16 is discussed in more detail below.

In FIG. 2 a schematic cross section of a drier chamber according to a second embodiment of this invention is shown. In FIG. 2 the drier is again shown in a static, non-operating, condition.

As the part numbers carried forward from FIG. 1 show, most of the parts of this second embodiment are the same as those shown for the, first embodiment. The difference is that a cylindrical member 18 coaxial with the lower conical member 2 and the upper conical member 8 is inserted between them. The cylindrical member 18 is attached at its lower end 19 to the upper end 10 of the lower conical member by the fourth flange joint 20. The cylindrical member 18 is attached at its upper end 21 to the lower end 9 of the upper conical member 8 by the fifth flange joint 22. Again, the use of flange joints has been found to be convenient.

Figures 3, 4:
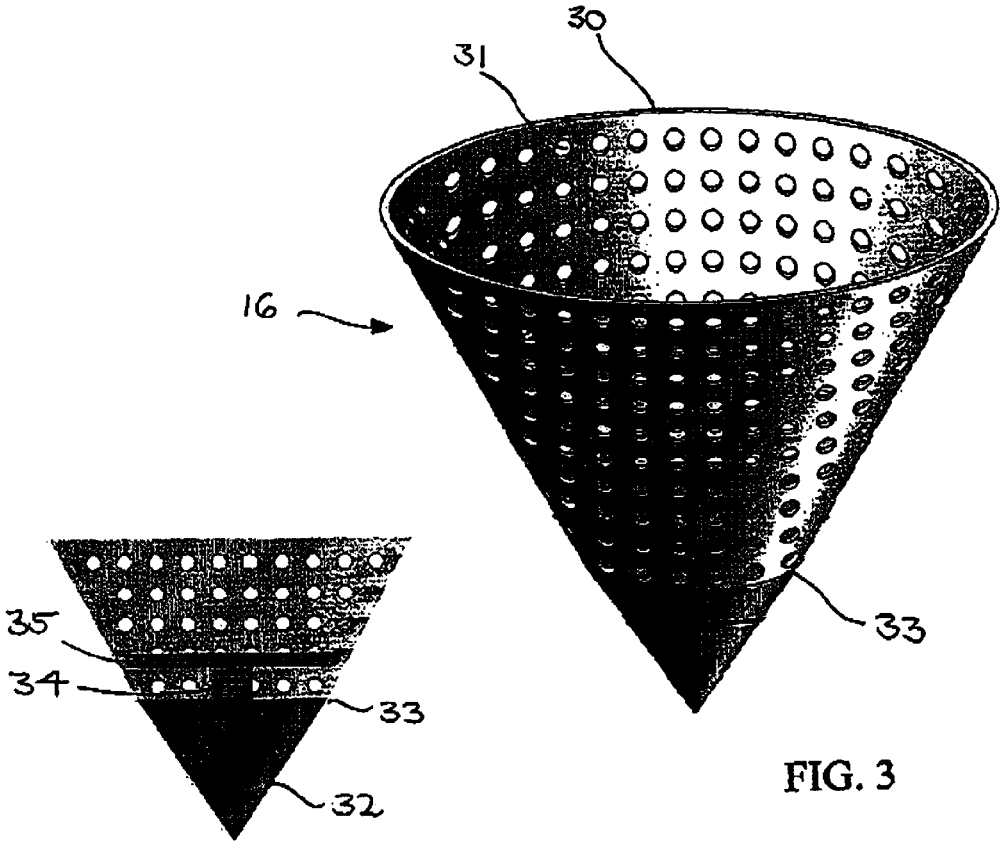
FIG. 3 shows in more detail the second upper conical screen used in FIGS. 1 and 2.
FIG. 4 shows in more detail the construction of the lower end of the screen shown in FIG. 3.

FIGS. 3 and 4 show in more detail the upper conical screen 16. As can be seen in FIG. 3, the conical screen is fabricated from a sheet 30 of, for example, steel which is provided with a plurality of round holes 31. If desired, other hole shapes can be used. The maximum effective diameter of the holes 31 should be about 85% of the effective diameter of the inert particles. The free space provided by the holes 31 and the actual size of the holes is chosen to provide adequate gas flow for the hot gas laden with powder detached from the inert particles in the collision zone and to prevent the loss of inert particles into the hot gas outlet 14 (shown in FIG. 1). Experience shows that a suitable open area fraction for the holes is from about 55% to about 72%. Experience shows that the third cone angle in the conical screen is from about 30° to about 45°.

FIG. 4 shows one convenient way of sealing the lower pointed end of the conical screen. A conical boss 32 with a top end diameter substantially the same as that of the bottom end 33 of the conical screen 16 (shown in FIG. 3) is screwed onto a threaded rod 34 carried by a crossbar 35 inside the conical screen 16.

Figure 5:
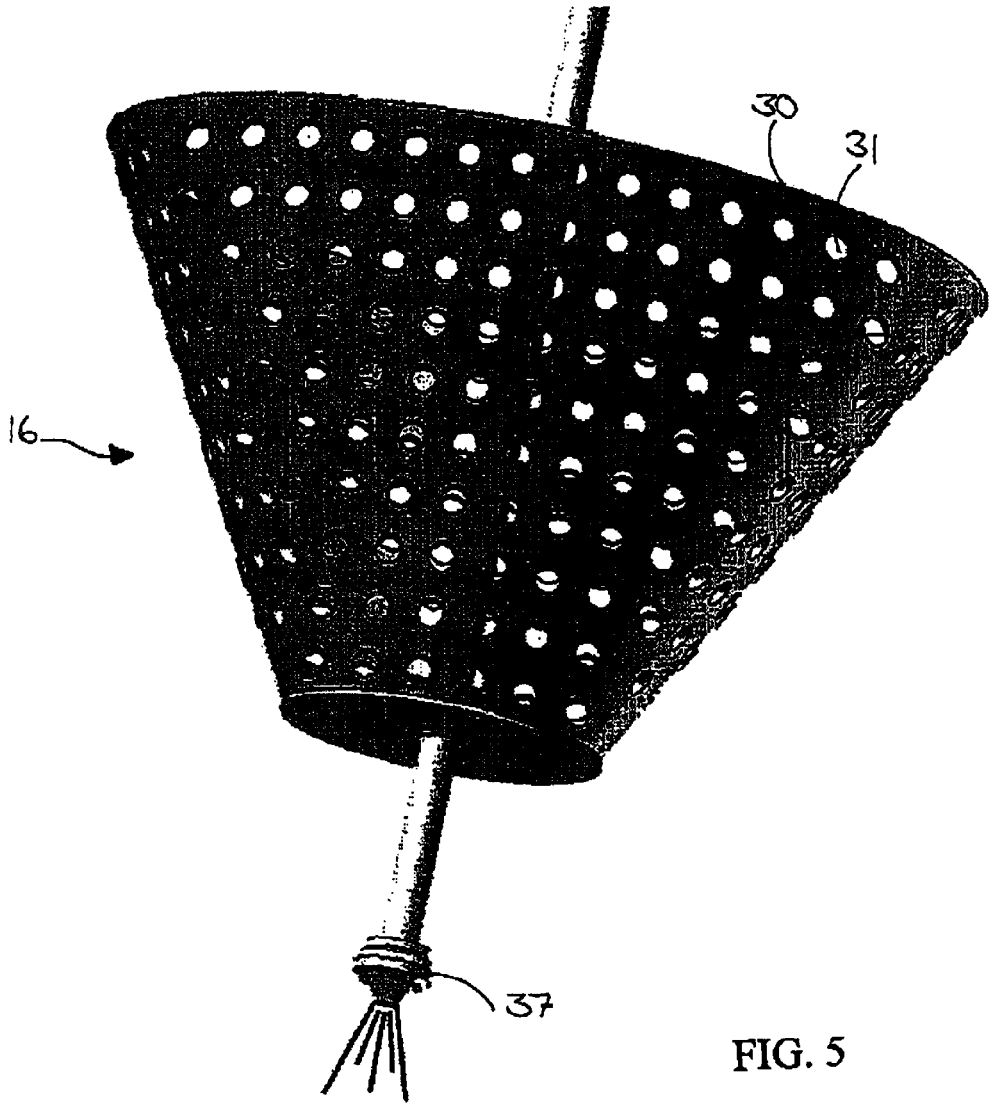
FIG. 5 shows an alternative construction to that shown in FIG. 3.

In the conventional jet spouted fluidised bed drier as described by Legros et al. the inlet port(s) are located near to the bottom of the lower conical section of the drier. It is however sometimes desirable to locate the slurry inlet port near to the top of the drier. FIG. 5 shows an alternative construction to that in FIG. 3 which includes provision for top feed. The conical screen 16 is essentially unchanged and comprises a sheet 30 with a plurality of holes 31. The biomaterial slurry inlet port comprises a tubular member which includes an atomising device, and a spray head 37 which is substantially coaxial with the conical screen 16. In use, the atomised biomaterial slurry is pumped under pressure through the atomiser and sprayed onto the fluidised spouted flow of inert particles below it through the spray head 37.

There is some choice for the material from which the inert particles may be fabricated. Possible materials include glass, polymer resins, polypropylene, polyethylene, PVC, silica gel, and polytetrafluoroethylene. The factors governing the choice of material are that first it must be able to sustain the effects of multiple collisions without substantial damage. For example, glass cannot be used for products such as dried eggs and dried starch intended for use in food due to the risk of glass powder getting into the finished product. Second, the material must be thermally stable under the operating conditions of the drier. This condition eliminates many plastics, unless the drier is to operate at a comparatively low temperature. Third, it is desirable that the particles are able to accumulate heat relatively quickly. Fourth, the particles need to be substantially inert to the material being dried at the drying temperature. The material which appears to meet these restrictions the best is polytetrafluoroethylene.

There is also some choice as to particle shape. Both cubes and spheres are readily made. Experience indicates that spheres work better in the collision process.

There is also some choice for the internal angles for the three cones: the bottom member, the top member and the conical screen. It appears to be convenient to fabricate the top and bottom members to the same cone angle. An effective cone angle for these two units appears to be in the range of from about 30° to about 45°. A preferred angle is about 40°. For the upper conical screen it appears that a cone angle of from about 30° to about 45° is effective.

COMPARATIVE EXAMPLES

Several materials have been dried using both a jet spouted fluidised bed drier as described by. Benali et al, and the drier of this invention. In the following data, reference to a Type II drier refers to a drier as described by Benali et al. which has a hemispherical top part, and reference to a Type III drier refers to a drier according to this invention which has a conical top part. The reader is referred to Benali et al., in Proceedings of Symposium on Energy Engineering, Hong Kong, 2000, for more details of the Type II drier.

1. Meat Rendering Slurry(MRS).

It is extremely difficult to dry MRS in a Type II drier. Experiments have shown that minimal drying, that is to say the loss of a significant amount of the water from the slurry of MRS, does not happen. The main result is that the greasy fat containing solids in the sludge coat the inner surfaces of the drier and choke it. No significant improvement is observed when a so-called drying-aid agent such as calcium carbonate powder or wheat bran is added.

In a type II drier the results in Table 1 have been obtained processing MRS with calcium carbonate included as a drying aid.

TABLE 1

| Drying Aid | % by weight Drying Aid. | Initial Moisture content, % by weight | Feed rate, kg/hr. | Final moisture content, % by weight | Drier Thermal efficiency | Energy efficiency |
|---|---|---|---|---|---|---|
| $CaCO_3$ | 4.6 | 85.6 | 140 | 2.8 | 69% | 58.3% |
| $CaCO_3$ | 4.6 | 85.6 | 114 | 3.2 | 51% | 45.8% |

Notes.
1. The thermal drier efficiency is defined as the ratio between the total heat required to evaporate the water and the energy supplied.
2. The energy efficiency includes the total energy consumption, including ancillary items such as blowers, pumps, and mixers.

The effect of using a drying aid agent has also been investigated in the context of drying MRS in the Type III drier according to this invention. A series of experiments showed that in the Type III drier there is a remarkable reduction of the adhesion of the dried slurry on the inner walls of the Type III drier in comparison with the Type II drier. When calcium carbonate was used as the drying-aid agent the recovery ratio of powdery product of from 20% to 30% with the Type II drier was increased to 68% to 85% with the Type III drier.

2. Pea Starch.

This material is difficult to process because the final moisture content must be carefully controlled. As FIG. 5 shows, an acceptable final moisture content can only be achieved with a Type II drier at a relatively low feed rate. With a Type III drier the water content can be controlled over a significant range and over a significant range of feed rates, from about 60 kg/hr. to about 120 kg/hr and still stay within the upper acceptable water content limit.

What is claimed is:

1. A jet spouted fluidised bed drier for the drying of a slurry of biomaterials including in combination:

a hot gas inlet means constructed and arranged to allow the passage of hot high velocity gas into the bottom of the chamber in a substantially upward vertical direction;

a first lower conical member in which the cone axis is substantially vertical having its lower narrow end connected to the hot gas inlet and having an upper wide end and a first internal cone angle;

a first lower screen located in the first conical member adjacent its connection with the hot gas inlet means;

a second upper conical member in which the cone axis is substantially vertical and coaxial with the cone axis of the first conical member having its lower wide end connected to the upper wide end of the first conical member and having an upper narrow end and a second internal cone angle;

a hot gas outlet means connected to the upper narrow end of the second conical member constructed and arranged to allow the passage of hot high velocity gas from the upper narrow end of the second conical chamber in a substantially upward vertical direction;

a second upper conical screen having a cone axis, an upper wide end, a lower closed end and a third internal cone angle;

a suitable quantity of inert carrier particles contained within the first and second conical members; and at least one inlet port for the slurry of biomaterials constructed and arranged to provide an atomised flow of the slurry into the chamber;

wherein:

(a) the first lower screen is constructed and arranged to prevent the inert carrier particles from escaping into the hot gas inlet means;

(b) the second upper conical screen has its cone axis coaxial with the cone axis of the second upper conical member;

(c) the second upper conical screen is connected to the second upper conical member adjacent to and surrounding the hot gas exit means; and (d) the second upper conical screen is constructed and arranged to prevent the inert carrier particles from escaping into the hot gas outlet means.

2. A jet spouted fluidised bed drier for the drying of a slurry of biomaterials including in combination:

a hot gas inlet means constructed and arranged to allow the passage of hot high velocity gas into the bottom of the chamber in a substantially upward vertical direction;

a first lower conical member in which the cone axis is substantially vertical having its lower narrow end connected to the hot gas inlet and having an upper wide end and a first internal cone angle;

a first lower screen located in the first conical member adjacent its connection with the hot gas inlet means;

a cylindrical member in which the cylinder axis is substantially coaxial with the cone axis of the first conical member having its lower end connected to the upper end of the first conical member and having an upper end;

a second upper conical member in which the cone axis is substantially vertical and coaxial with the cylinder axis of the cylindrical member having its lower wide end connected to the upper end of the cylindrical member and having an upper narrow end and a second internal cone angle;

a hot gas outlet means connected to the upper narrow end of the second conical member constructed and arranged to allow the passage of hot high velocity gas from the upper narrow end of the second conical chamber in a substantially upward vertical direction;

a second upper conical screen having a cone axis, an upper wide end, a lower closed end and a third internal cone angle;

a suitable quantity of inert carrier particles contained within the first and second conical members; and at least one inlet port for the slurry of biomaterials constructed and arranged to provide an atomised flow of the slurry into the chamber;

wherein:

(a) the first lower screen is constructed and arranged to prevent the inert carrier particles from escaping into the hot gas inlet means;

(b) the second upper conical screen has its cone axis coaxial with the cone axis of the second upper conical member;

(c) the second-upper conical screen is connected to the second upper conical member adjacent to and surrounding the hot gas exit means; and (d) the second upper conical screen is constructed and arranged to prevent the inert carrier particles from escaping into the hot gas outlet means.

3. A drier according to claims 1 or 2 wherein the first and the second internal cone angles are the same.

4. A drier according to claims 1 or 2, wherein the first and the second cone angles are each from about 30° to about 45°.

5. A drier according to claims 1 or 2 wherein the first and the second cone angles are each about 40°.

6. A drier according to claims 1 or 2 wherein the third cone angle is from about 30° to about 45°.

7. A drier according to claims 1 or 2 wherein the third cone angle is about 40°.

8. A drier according to claims 1 or 2 wherein the inert carrier particles are fabricated from a material chosen from the group consisting of glass, polymer resin, polypropylene, PVC, silica gel and polytetrafluoroethylene.

9. A drier according to claims 1 or 2 wherein the inert carrier particles are fabricated from polytetrafluoroethylene.

10. A drier according to claims 1 or 2 wherein the inert carrier particles are fabricated as spheres or cubes.

11. A drier according to claims 1 or 2 wherein the inert carrier particles are fabricated as spheres.

12. A drier according to claims 1 or 2 wherein the inert carrier particles are fabricated as polytetrafluoroethylene spheres.

* * * * *